US008712085B2

(12) United States Patent
Thomasson et al.

(10) Patent No.: US 8,712,085 B2
(45) Date of Patent: Apr. 29, 2014

(54) LIGHT POWERED HEARING AID

(75) Inventors: Samuel L. Thomasson, Gilbert, AZ (US); Fan Wu, Scottsdale, AZ (US)

(73) Assignee: Zounds Hearing, Inc., Tempe, AZ (US)

( * ) Notice: Subject to any disclaimer, the term of this patent is extended or adjusted under 35 U.S.C. 154(b) by 1416 days.

(21) Appl. No.: 12/154,464

(22) Filed: May 23, 2008

(65) Prior Publication Data

US 2009/0290738 A1 Nov. 26, 2009

(51) Int. Cl.
*H04R 25/00* (2006.01)

(52) U.S. Cl.
USPC ..... 381/323; 381/174

(58) Field of Classification Search
USPC ..... 381/318–331, 174
See application file for complete search history.

(56) References Cited

U.S. PATENT DOCUMENTS

| | | | | |
|---|---|---|---|---|
| 1,219,411 | A | 3/1917 | Williams | 381/323 |
| 3,297,933 | A | 1/1967 | McCarthy | 320/107 |
| 5,210,804 | A * | 5/1993 | Schmid | 381/323 |
| 5,253,300 | A | 10/1993 | Knapp | 381/68.6 |
| 5,303,305 | A | 4/1994 | Raimo et al. | 381/68 |
| 5,719,528 | A * | 2/1998 | Rasmussen et al. | 330/10 |
| 6,229,900 | B1 | 5/2001 | Leenen | 381/314 |
| 6,252,287 | B1 | 6/2001 | Kurtz et al. | 257/461 |
| 6,310,960 | B1 * | 10/2001 | Saaski et al. | 381/323 |
| 7,825,325 | B2 * | 11/2010 | Kennedy et al. | 136/244 |
| 2003/0142841 | A1 * | 7/2003 | Wiegand | 381/172 |
| 2009/0213283 | A1 * | 8/2009 | Burlingame et al. | 349/14 |

* cited by examiner

*Primary Examiner* — David Vu
*Assistant Examiner* — Jonathan Han
(74) *Attorney, Agent, or Firm* — Cahill Glazer PLC

(57) ABSTRACT

A hearing aid includes a case and a photovoltaic cell located in the case near a translucent portion of the case. A detector circuit includes a voltage comparator for monitoring the voltage from the photocell and indicating variations in voltage. The variations are analyzed to detect data for operating the hearing aid.

13 Claims, 1 Drawing Sheet

LIGHT POWERED HEARING AID

This invention relates to hearing aids and, in particular, to a hearing aid in which a photovoltaic cell provides both power and communication.

BACKGROUND TO THE INVENTION

Hearing aids powered by a battery have been known for almost a century; see U.S. Pat. No 1,219,411 (Williams), for example. Modern technology has increased battery life greatly, yet it is annoying to have to replace batteries. Rechargeable batteries are a partial solution but require removal of the hearing aid and placement in a charger. Unless a user has two sets of hearing aids, the charging can be inconvenient.

Hearing aids having rechargeable batteries have been known in the art for a long time; e.g., see U.S. Pat. No. 3,297,933 (McCarthy). The trade-off between rechargeable batteries and non-rechargeable batteries is the inconvenience of having to replace the battery. There is also a trade-off in capacity. A non-rechargeable battery lasts much longer than a rechargeable battery having the same outside dimensions as the non-rechargeable battery.

Using light to recharge the battery in a hearing aid is disclosed in U.S. Pat. No. 5,210,804 (Schmid) and U.S. Pat. No. 5,253,300 (Knapp). In the Schmid patent, a photovoltaic cell is behind a semi-transparent door in a hearing aid. The cell does not recharge the battery during use. At night, the door is opened and the hearing aid is placed in a stand that shines light from lamps onto the photovoltaic cell. In the Knapp patent, the photovoltaic cell is external to the hearing aid, part of a recharging case. U.S. Pat. No. 5,303,305 (Raimo et al.) discloses a hearing aid powered by a secondary battery that is recharged by a photovoltaic cell on the hearing aid.

It is known in the art to control or program a hearing aid using radio frequency (RF) transmissions. It is also known in the art to transmit data to a hearing aid having a diode sensitive to infrared radiation; see U.S. Pat. No. 6,229,900 (Leenen). Remote controls for hearing aids are no less likely to be misplaced or need new batteries than remote controls for any other device. It is desired to eliminate the tedium of needing a remote control.

GLOSSARY

A "primary" battery is one that is not intended for charging even though, in fact, one can safely recharge the battery one or a few times. A "secondary" battery is one that is intended for recharging a plurality of times. In general, primary batteries have a greater capacity (store more energy) than rechargeable batteries. Secondary batteries have a different internal structure from primary batteries, even when the chemistry involved is nominally the same.

The ordinary and accepted meaning of "translucent" is capable of transmitting light but causing sufficient diffusion to eliminate perception of distinct images. As used herein, "translucent" means capable of transmitting more than fifty percent of light incident normal to a surface. Thus, "translucent" includes media that is transparent.

A "speaker" generates sound from an electrical signal. In the hearing aid art, one often encounters the term "receiver" for such a device, which reads strangely to the uninitiated. "Electroacoustic transducer" is clumsy and pedantic. Thus, "speaker" is the term used for describing this invention.

In view of the foregoing, it is therefore an object of the invention to provide a hearing aid with a photovoltaic cell that is used for power, charging a battery, communication, and control.

Another object of the invention is to eliminate the need for a separate remote control.

SUMMARY OF THE INVENTION

The foregoing objects are achieved by this invention in which a hearing aid includes a case and a photovoltaic cell located in the case near a translucent portion of the case. A detector circuit includes a voltage comparator for monitoring the voltage from the photocell and indicating variations in voltage. The variations are analyzed to detect data for operating the hearing aid.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
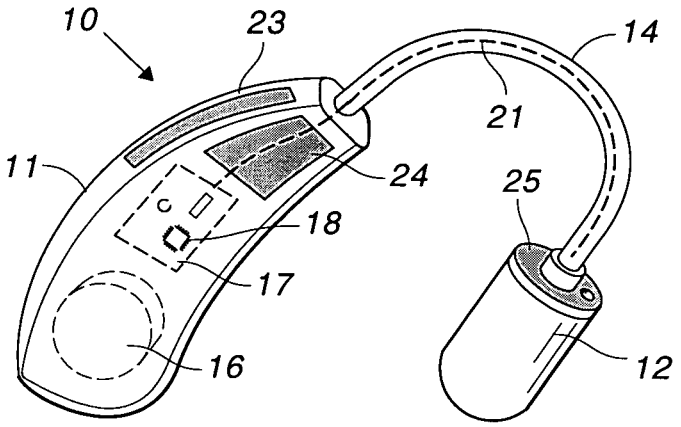
FIG. 1 illustrates a hearing aid constructed in accordance with a preferred embodiment of the invention.

In FIG. 1, hearing aid 10 includes body 11 coupled to earpiece 12 by cable 14. Within body 11 are battery 16 and circuit board 17. Circuit board 17 includes programmed microprocessor 18 and other circuitry for processing audio signals, charging battery 16, and other functions. A speaker (not shown) is located in earpiece 12 and a microphone (not shown) is located in body 11. The speaker is coupled to circuit board 17 by wires 21 in cable 14.

In accordance with one aspect of the invention, hearing aid 10 includes photovoltaic cell 23 located underneath a translucent portion of case 11. Cell 23 is electrically coupled to circuit board 17 and is both a source of power for operating the hearing aid and a source of current for recharging battery 16.

Figure 2:
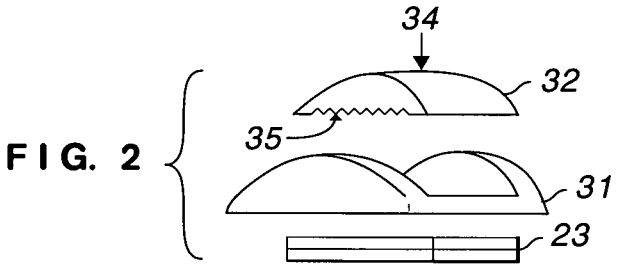
FIG. 2 illustrates a light gathering member adjacent a multi-junction photocell.

Preferably, the translucent portion of case 11 is lenticular in order to increase the amount of power available from the photovoltaic cell. As illustrated in FIG. 2, section 31 of hearing aid 10 (FIG. 1) receives translucent, lenticular member 32. As a separate piece, it is easier to control the optical properties of member 32. Preferably, member 32 gathers diffuse light at the wavelengths absorbed by cell 23.

Member 32 is fastened to the case with a suitable adhesive. Member 32 is lenticular in the sense that light incident upon the member is redirected to a smaller angle of incidence on the underlying photovoltaic cell, as illustrated in FIG. 4. The light is gathered or "collimated" somewhat but not in the sense that light rays are necessarily made parallel. Member 32 preferably includes convex upper surface 34 and corrugated lower surface 35 for gathering light. To some extent, the degree of curvature of upper surface 34 depends upon the type and design of the hearing aid.

The lens can be cylindrical, spherical, or a compound surface. Lower surface 35 can be prismatic or Fresnel. Transparent acrylic is a preferred material for member 32. Polycarbonate or other translucent materials can be used instead.

Photovolaic cell 23 is preferably what is called a multi-junction cell. For example, U.S. Pat. No. 6,252,287 (Kurtz et al.) discloses a veritable parfait of semiconductor layers in a multi-junction photovoltaic cell. Simpler designs are also usable and preferred. There are many combinations of layers possible. The band gaps of the layers are different from each other and the band gaps are arranged in descending order. Light is first incident upon the layer having the largest band gap, which absorbs at the shortest wavelength. Deeper layers absorb at progressively longer wavelengths. Output current varies with the amount of available light.

Figure 3:
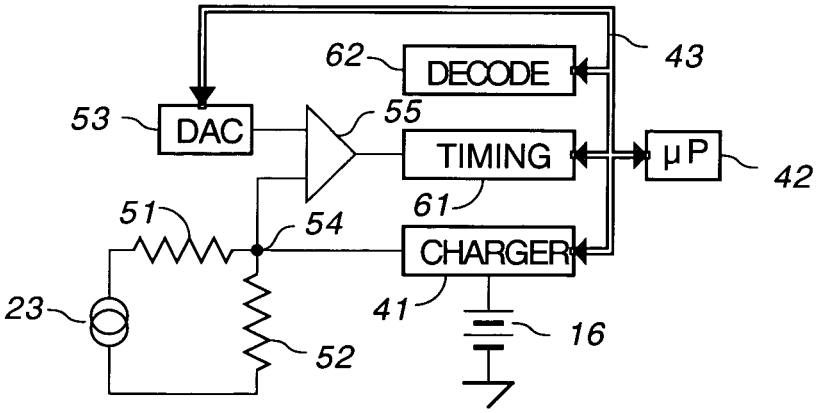
FIG. 3 is a block diagram of a circuit for providing a plurality of functions from a photocell.

FIG. 3 illustrates a portion of the electronics on circuit board 17 (FIG. 1). Battery 16 is charged by photovoltaic cell 23 and charger 41. Charger 41 can operate independently of microprocessor 42 or be controlled by microprocessor 42 through bus 43. Preferably, at a minimum, charger 41 provides data to microprocessor 42 concerning the states of battery 16 and photovoltaic cell 23.

Current from cell 23 flows through series resistor 51. A small current flows through resistor 52, producing a voltage at junction 54 that is coupled to one input of amplifier 55. The resistance of resistor 52 is substantially greater than, e.g. more than ten times, the resistance of resistor 51. A second input to amplifier 55 is coupled to digital to analog converter (DAC) 53. DAC 53 is controlled by microprocessor 42 through bus 43. Amplifier 55 compares the voltages on the inputs and produces and output signal indicative of which input is receiving the higher voltage. This is used to monitor the current from photovoltaic cell 23, which depends on the intensity of incident light.

During normal operation, the data sent to DAC 53 establishes a low threshold of incident light and the output from amplifier 55 is in a first state. When incident light falls below the threshold, the output from amplifier 55 changes to a second state. The durations of the changes in state, i.e., the periods between changes of state, are monitored by timing circuit 61, which provides data representative of the periods to bus 43. This data is analyzed by microprocessor 42 or by decoder 63. Successive changes in state produce a pulse width modulated (PWM) signal from amplifier 55. The periods of the pulses are determined by the cause of the change in light level.

In accordance with one aspect of the invention, a low frequency signal is interpreted as a command from the person wearing the hearing aid, who simply covers the hearing aid for a brief time to produce a pulse. This pulse can be used as a switch for functions within hearing aid 10 (FIG. 1). A series of low frequency pulses can also be used to control functions of the hearing aid. Preferably, the most frequently used functions are associated with the fewest pulses. For example, switching between two levels of gain can be activated with a single pulse. Thus, if a person covers his ear for five seconds, gain is reduced by a set amount. If the person covers his ear for two or three seconds, gain is increased. The timing is made flexible by accepting wide variations in pulse width; i.e. a "window" of time is created in software in which a change of state can occur. For example, two seconds to four seconds is interpreted as a signal to increase gain, whereas a pulse must be between five seconds and seven seconds to be interpreted as a signal to decrease gain. The period analysis is done by either decode circuit 63 or microprocessor 42. Periods that are not recognized are ignored.

Faster, that is higher frequency, changes in light level are interpreted by the same circuitry as command signals from a remote control. Because the photovoltaic cells are sensitive to visible light, the considerable flicker in light levels caused by fluorescent lighting, computer monitors, television sets, or other remote control units is filtered out by decode circuit 63 or microprocessor 42. Thus, signals below approximately 5 Hz are interpreted as commands directly from a user and signals above approximately 5 Hz are interpreted as signals from a remote control. Preferably, infrared light is used for communication with a remote control but visible light can be used instead or in addition. Photovoltaic cell 23 and amplifier 55 thus provide a serial interface to a hearing aid.

Microprocessor 42 is programmed to execute a plurality of routines and can appear to be performing several functions simultaneously. For example, in one routine, light level is compared with a low threshold, as described above, looking for commands. If none is found, a second routine is executed in which light level is measured; e.g. by stepwise increasing the voltage from DAC 53 until amplifier 55 changes state, then reading the data that caused the transition. The search is preferably binary rather than sequential. This is known in the art as a "poor man's" analog to digital converter because other, more elegant techniques for analog to digital conversion are more complicated and more expensive. Also, it avoids adding a separate circuit for analog to digital conversion and can be faster to execute. A third routine is to monitor battery voltage through charger 41. Circuitry (not shown) disconnects loads from battery 16 and open circuit voltage is measured and sent to microprocessor 42 over bus 43.

These and other routines are not necessarily executed sequentially but can be executed in any order as determined by an executive routine or by interrupts. For example, the routine to look for commands can be executed alternately with all the other routines.

Returning to FIG. 1, hearing aid 10 includes photovoltaic cells 24 and 25. These cells are preferably combined with photovoltaic cell 23 to increase available energy for charging or operating the hearing aid. Alternatively, photovoltaic cell 25 is used for detecting signals and cells 23 and 24 are used for power. Preferably, all cells are used for signaling but are individually monitored. Thus, for example, if cell 25 detects a very low light level of long duration and cell 23 does not, then it is likely that the user has placed a handset from a telephone against his ear. This information is used, for example, to reduce gain from microphones in the body of hearing aid 10 and turn on microphone 71 in earpiece 12, if it were not on.

Case 11 and the photovoltaic cell can be combined by coating a case with a photovoltaic thin film, such as cadmium telluride (CdTe), and a protective layer over the thin film. A single film is preferred but a segmented film can be used instead depending, for example, upon the shape of the case.

The invention thus provides a hearing aid with a photovoltaic cell that is used for power, charging a battery, communication, and control. A separate remote control is unnecessary.

Having thus described the invention, it will be apparent to those of skill in the art that various modifications can be made within the scope of the invention. For example, data can be sent to hearing aid 10 for setting operating parameters within the hearing aid, e.g. gain vs. frequency. The logic of the output from amplifier 55 can be inverted; i.e., the output can indicate which input is receiving the lower voltage. Any preset function can be changed by a user without the need for a remote control. For example, different patterns of correction, such as "living room," "theater," and "restaurant," can be selected by covering the hearing aid for selected periods. The function of timing circuit 61 can be incorporated into microprocessor 42. Amplifier 55 would then be coupled to an input pin of microprocessor 42. While illustrated with separate blocks for various functions, everything but the photovoltaic cell, the charger, and the battery can be incorporated into one suitably programmed microprocessor or microcontroller. Separate blocks are illustrated for ease of understanding, not as a restriction on implementing the invention. The invention can be implemented in analog or digital, integrated or discrete form.

What is claimed as the invention is:

1. A hearing aid comprising in combination:

a) a case containing electronics for processing audio signals, b) a battery for powering the electronics, c) a photovoltaic cell responsive to light for generating an electrical voltage, d) a charging circuit coupled to the photovoltaic cell for charging the battery, e) a voltage comparator having an input coupled to the photovoltaic cell and being responsive to the electrical voltage generated thereby, the voltage comparator including an output for providing a first output signal when the electrical voltage generated by the photovoltaic cell is greater than a reference voltage, and for providing a second output signal when the electrical voltage generated by the photovoltaic cell is less than said reference voltage, and f) a timer coupled to the output of the voltage comparator, said timer detecting changes at the output of the voltage comparator between the first output signal and the second output signal having a duration of approximately 0.2 seconds or longer resulting from variations in the intensity of light incident upon said photovoltaic cell, g) wherein said electronics for processing audio signals is responsive to the timer for controlling the manner in which such audio signals are processed.

2. The hearing aid as set forth in claim 1 and further including a digital to analog converter for producing a reference voltage coupled to said voltage comparator.

3. The hearing aid as set forth in claim 1 and further including a microprocessor coupled to said timer.

4. The hearing aid as set forth in claim 3 wherein said microprocessor is programmed with several routines and said microprocessor is responsive to said timer for selecting which routine to execute.

5. The hearing aid as set forth in claim 1 wherein said hearing aid includes more than one photovoltaic cell.

6. The hearing aid as set forth in claim 1 wherein said photovoltaic cell is a thin film coating on said case.

7. The hearing aid as set forth in claim 1 further including a programmed microprocessor, and wherein said timer is implemented as software in said microprocessor.

8. A hearing aid comprising in combination:

a) a case containing electronics for processing audio signals, b) a battery for powering the electronics, c) a photovoltaic cell responsive to light for generating an electrical voltage, and d) a charging circuit coupled to the photovoltaic cell for charging the battery, e) a voltage comparator having an input coupled to the photovoltaic cell and being responsive to the electrical voltage generated thereby, the voltage comparator including an output for producing a pulse width modulated signal when the intensity of light incident upon the photovoltaic cell crosses a threshold magnitude, f) a timer coupled to the output of the voltage comparator, said timer detecting data received as variations in the intensity of light incident upon said photovoltaic cell, g) wherein said pulse width modulated signal has a frequency below approximately 5 Hz.

9. The hearing aid as set forth in claim 8 and further including a digital to analog converter for producing a reference voltage coupled to said voltage comparator.

10. The hearing aid as set forth in claim 8 and further including a microprocessor coupled to said timer.

11. The hearing aid as set forth in claim 10 wherein said microprocessor is programmed with several routines and said microprocessor is responsive to said timer for selecting which routine to execute.

12. The hearing aid as set forth in claim 8 further including a programmed microprocessor, and wherein said timer is implemented as software in said microprocessor.

13. A method of controlling a hearing aid, the hearing aid including a case containing electronics for processing audio signals, a battery for powering the electronics, first and second photovoltaic cells each responsive to light for generating an electrical voltage, a charging circuit coupled to at least one of the first and second photovoltaic cells for charging the battery, and a control circuit for selecting from among a plurality of audio signal processing modes, the method comprising the steps of:

a) monitoring the intensity of light incident upon the first photovoltaic cell;

b) monitoring the intensity of light incident upon the second photovoltaic cell;

c) detecting that the light incident upon the first photovoltaic cell has been reduced to a low intensity for a predetermined duration of approximately two seconds or more, while the light incident upon the second photovoltaic cell remains at a significantly higher intensity over the same duration, and generating a mode selection signal in response to such detection; and d) causing the control circuit to change a currently selected audio signal processing mode in response to the generation of the mode selection signal in step c).

* * * * *